US007063593B2

(12) United States Patent
Carpenter

(10) Patent No.: US 7,063,593 B2
(45) Date of Patent: Jun. 20, 2006

(54) APPARATUS AND PROCESS FOR SURFACE TREATING INTERIOR OF WORKPIECE

(75) Inventor: Steven J. Carpenter, East Jordan, MI (US)

(73) Assignee: Roto-Finish Company, Inc., Kalamazoo, MI (US)

( * ) Notice: Subject to any disclaimer, the term of this patent is extended or adjusted under 35 U.S.C. 154(b) by 0 days.

(21) Appl. No.: 10/782,221

(22) Filed: Feb. 19, 2004

(65) Prior Publication Data

US 2004/0162009 A1 Aug. 19, 2004

Related U.S. Application Data

(63) Continuation of application No. 09/927,889, filed on Aug. 10, 2001, now abandoned.

(51) Int. Cl.
*B24B 1/00* (2006.01)

(52) U.S. Cl. ..... 451/36; 451/51; 451/61; 451/76; 451/102; 451/162; 134/7; 134/8; 134/22.12; 134/152; 134/166 R

(58) Field of Classification Search ..... 451/36, 451/51, 61, 76, 162, 102, 37–40, 49, 57, 451/59, 60, 64, 75, 89–92, 99, 163, 381, 451/164; 134/7, 8, 22.11, 22.12, 24, 54, 134/152, 166 R, 167 R See application file for complete search history.

(56) References Cited

U.S. PATENT DOCUMENTS 2,501,887 A 3/1950 Cress
2,821,814 A 2/1958 Fritze
3,385,006 A * 5/1968 Miller et al.
3,507,712 A * 4/1970 Scott
3,877,647 A 4/1975 Gorobets et al.
3,972,150 A * 8/1976 Hart
4,149,913 A 4/1979 Kunioka et al.
4,380,477 A 4/1983 Saunders
4,674,238 A * 6/1987 Suzuki et al.
4,995,201 A * 2/1991 von Borcke et al. ..... 451/76
5,441,441 A * 8/1995 Cook et al.
5,605,492 A * 2/1997 Klingel (Continued)

FOREIGN PATENT DOCUMENTS

GB 631 417 11/1949

(Continued)

OTHER PUBLICATIONS

International Search Report mailed Nov. 11, 2002 in PCT/US02/25128 (6 pages).

*Primary Examiner*—Hadi Shakeri
(74) *Attorney, Agent, or Firm*—Flynn, Thiel, Boutell & Tanis, P.C.

(57) ABSTRACT

A process and apparatus for surface treating boundary walls of an interior chamber formed in a workpiece. Nozzle members are inserted through access openings which communicate with opposite sides of the interior chamber and are positioned so that discharge openings of the nozzle members are disposed in closely adjacent and directly opposed relationship. High velocity streams of carrier fluid having entrained solid abrasive media therein are simultaneously discharged from the nozzle members so that the opposed streams directly violently impact and are deflected radially outwardly for impact against the surrounding boundary walls. The opposed nozzle members are preferably simultaneously synchronously moved lengthwise of the chamber to effect treating of the boundary walls.

33 Claims, 11 Drawing Sheets

U.S. PATENT DOCUMENTS 5,653,819 A 8/1997 Bee et al.
5,885,133 A * 3/1999 Williams, Jr.
5,992,404 A * 11/1999 Bleyer et al.

FOREIGN PATENT DOCUMENTS

GB 2 064 386 6/1981

* cited by examiner

APPARATUS AND PROCESS FOR SURFACE TREATING INTERIOR OF WORKPIECE

This is a continuation of Ser. No. 09/927,889, filed Aug. 10, 2001 now abandoned.

FIELD OF THE INVENTION

This invention relates to an apparatus and process for surface treating a boundary wall of an interior chamber associated with a workpiece such as a casting.

BACKGROUND OF THE INVENTION

Workpieces and particularly those formed as castings often have interior chambers formed therein which have only limited accessibility. Such interior chambers are often shaped and sized so that portions thereof are of significantly larger cross section than any access opening which communicates therewith, and such interior chambers also often include passages or the like which communicate with or project transversely from a main chamber or passage, and as such direct communication with these transverse passages from the access opening is oftentimes difficult or impossible. It is usually necessary to attempt to effect at least some treatment of the walls which define the boundary of the interior chamber in an effort to improve the smoothness and finish thereof, and/or effect removal of debris which may be loosely or firmly attached thereto. This is particularly true when the workpiece is formed as a casting since the core used for defining the interior chamber during the casting process breaks down quickly after pouring and forming of the workpiece, and the material defining the core has to be removed through the access opening, but some material frequently becomes trapped in the interior chamber and/or adheres to the surrounding walls so as to create a poor quality surface.

At the present time, the cleaning of the interior chambers of workpieces of this type involves various techniques such as shaking the workpiece on a vibrator, or injecting streams of fluids such as air or water into the chamber in an attempt to dislodge debris from the chamber or from the walls thereof. This technique, however, is relatively ineffective with respect to creating any significant improvement with respect to the smoothness or quality of the boundary walls.

Because of the difficulties associated with cleaning and treating interior walls of chambers defined within workpieces such as castings, in many instances flexible brushes are inserted, often manually, into the chamber to treat the boundary walls thereof. This technique is partially effective for those boundary walls which communicate with and are accessible from the access opening, but is of little value with respect to those walls which are associated with unusual shapes or transversly projecting regions of the interior chamber. Further, this technique is time consuming and inefficient.

Accordingly, it is an object of this invention to provide an improved apparatus and process which permits effective and efficient surface treating of boundary walls associated with interior chambers of workpieces, particularly castings, whereby the finished walls can have improved surface quality and the overall interior chamber can be cleaner and less likely to contain unwanted debris, and wherein the process is effective for interior chambers having complex configurations including passages remote from but interconnected to a main passage which communicates with an access opening, and which permits substantially automated or partially automated handling of workpieces and cleaning and surface finishing of interior chambers so as to greatly improve the cost effectiveness and efficiency associated with the manufacture and use of such workpieces.

SUMMARY OF THE INVENTION

According to the process and apparatus of the present invention, at least in a preferred embodiment, the workpiece such as a casting has an interior compartment or chamber therein defined by boundary walls, and a pair of generally aligned access openings are formed in opposite side walls of the workpiece and communicate with the interior chamber. The interior chamber may be enlarged in cross section relative to at least one of the access openings, and typically has passages projecting transversly therefrom so as to be disposed in non-aligned relationship relative to the access openings. A pair of elongate pipelike nozzle members having nozzle openings or apertures at the discharge ends thereof are disposed in aligned relationship so that the nozzle openings are disposed in opposed relationship. The nozzle members are mounted on carriers which enable them to be moved in the elongate direction thereof generally toward and away from one another, and synchronously in unison with one another along the elongate direction. Each of the nozzle members has the discharge opening configured to discharge a confined and approximately cylindrical stream therefrom, and each nozzle member is connected to a supply source which supplies a blasting fluid such as air to the nozzle members. The blasting fluid has entrained therein small solid abrasive particles. The pair of nozzle members are initially inserted from opposite sides of the workpiece through the access openings into the interior chamber so that the opposed discharge ends of the nozzles are positioned in closely adjacent and opposed relationship, with a gap or spacing between the discharge ends typically being of relatively small size. When energized the nozzles both emit high velocity confined streams of blasting fluid having abrasive particles entrained therein. The streams are oriented directly toward one another and hence almost immediately impact one against the other following their discharge from the nozzle members. The direct impacting of these two confined streams creates a violent reorientation of the high velocity flowing streams so that the merged streams are violently deflected radially outwardly around substantially the entire periphery of the streams and hence impact at relatively high velocity against the surrounding boundary wall of the interior chamber. At the same time the pair of nozzle members are linearly synchronously moved throughout the length of the interior chamber, and may be moved back and forth throughout the length of the chamber to create several passes, to effect surface treatment and finishing of the boundary wall. The radially outwardly directed high velocity blasting fluid created by the impact of the opposed streams, coupled with the movement of the nozzle members lengthwise of the interior chamber, causes the high velocity blasting streams containing therein the abrasive particles to violently impact against the boundary wall, including walls which are angled or project transverse to the lengthwise direction, so as to effect surface finishing and removing of loose debris, thereby resulting in a wall having a highly improved surface finish. At the same time the radially deflected streams of blasting fluid are able to pass into transverse passages or compartments which branch sidewardly from a main portion of the chamber so as to effect cleaning and surface treatment of the walls associated therewith.

Other objects and purposes of the present invention will be apparent to persons who are familiar with the environment and problems associated with this invention upon reading the following specification and inspecting the accompanying drawings.

Figure 1:
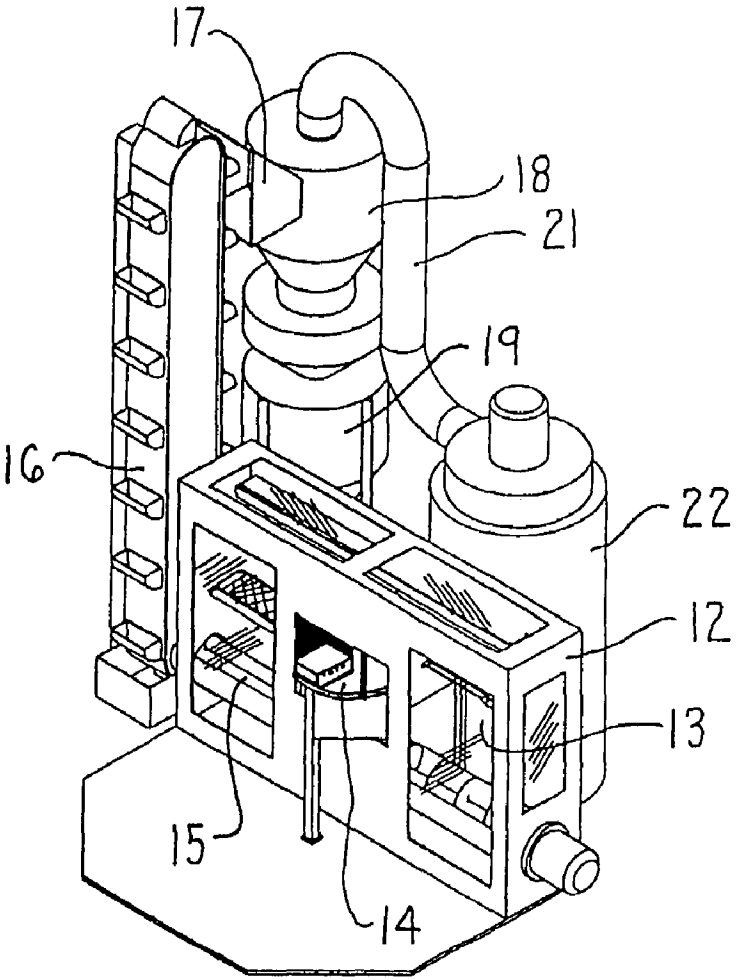
FIG. 1 is a perspective view of one embodiment of an overall work finishing station which can be used in conjunction with the surface treating apparatus and process of the present invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from the geometric center of the apparatus and designated parts thereof, and will also refer to movement directions relative to the workpiece. Said terminology will include the words specifically mentioned, derivatives thereof, and words of similar import.

DETAILED DESCRIPTION

Figure 2:
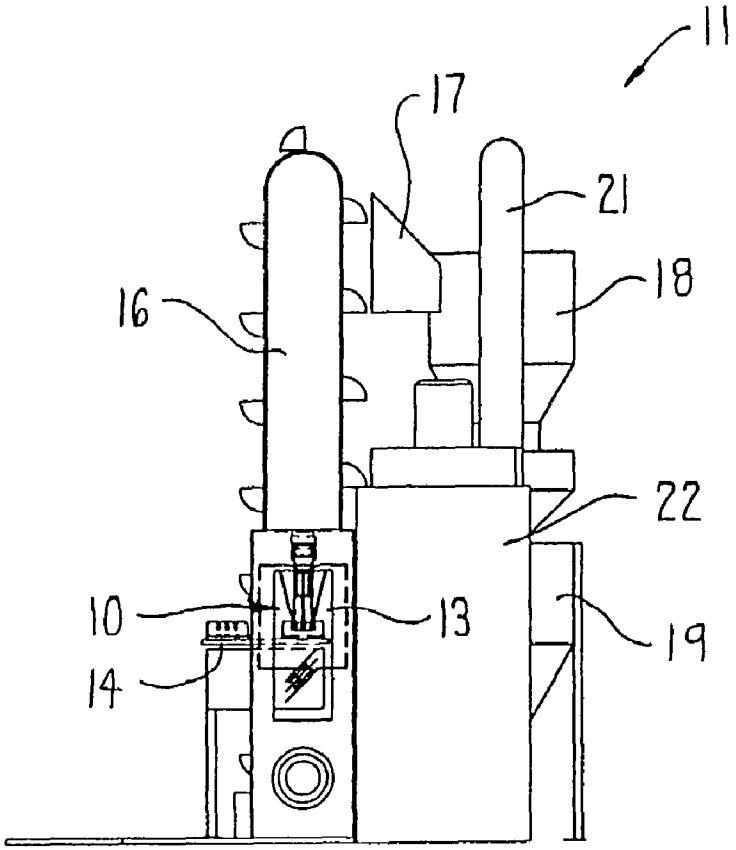
FIG. 2 is an end elevational view of the arrangement shown in FIG. 1.
Figure 3:
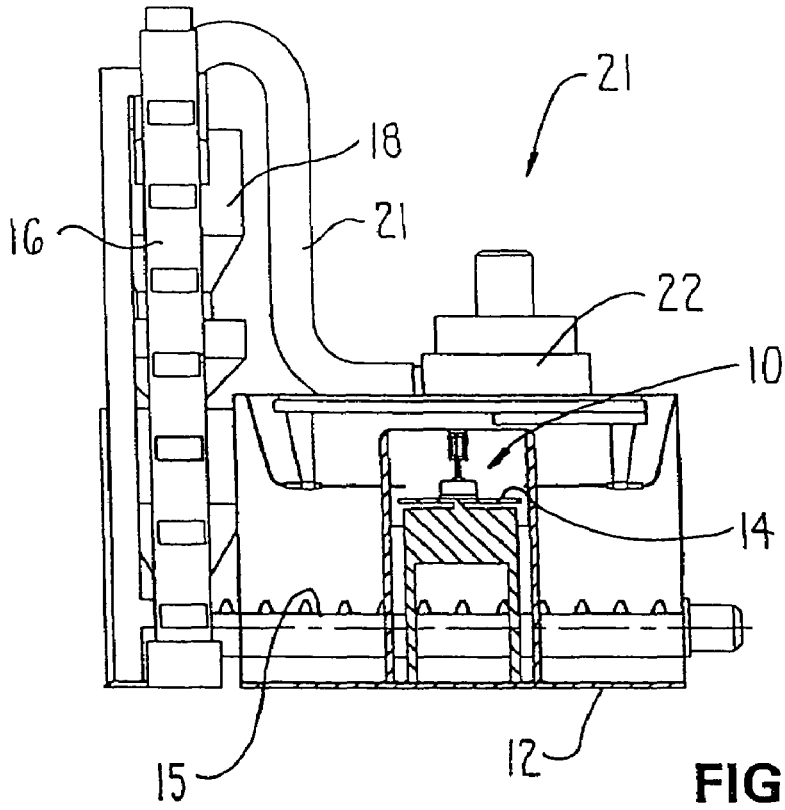
FIG. 3 is a front elevational view, partially broken away, of the arrangement shown in FIG. 1.

Referring to FIGS. 1–3, there is illustrated one example of a workpiece finishing station 11 which can be utilized in conjunction with the surface treating apparatus and process of this invention.

The arrangement 11 includes a main housing 12 which has the surface treatment apparatus 10 of this invention associated therewith, as defined hereinafter. The housing 12 defines therein an interior or shrouded treating chamber 13, and a rotatable workpiece-supporting turntable 14 is associated with the chamber 13 to permit workpieces to be mounted thereon. In the exemplary embodiment the table 14 has two diametrically opposed stations or fixtures so that one can be positioned within the treating chamber 13, and the other can be externally accessible from one side of the station 11 so that workpieces can be removed from and mounted on the turntable 14, either manually or automatically. A transporting conveyor 15 is associated with the lower part of the housing 12 so as to collect and transport the abrasive particles and debris which is utilized or created in the finishing process, and this collection of solids is transported to an elevating conveyor 16. The latter in turn transports the solid material upwardly and deposits it into a chute 17 whereby the solid material is fed into a separator 18, such as a cyclone separator. The unwanted debris and other solid matter is typically discharged downwardly into a collection hopper 19, whereas the particulate abrasive media is separated and sent through a conduit 21 so as to be resupplied to a chamber 22 for reuse. The abrasive media in the compartment 22 is thereafter entrained in a supply of pressurized carrier fluid such as air or water, and the pressurized media (i.e., the fluid with entrained abrasive particles) is then supplied to the surface treating apparatus 10 for treating a workpiece, as explained hereinafter.

Figure 4:
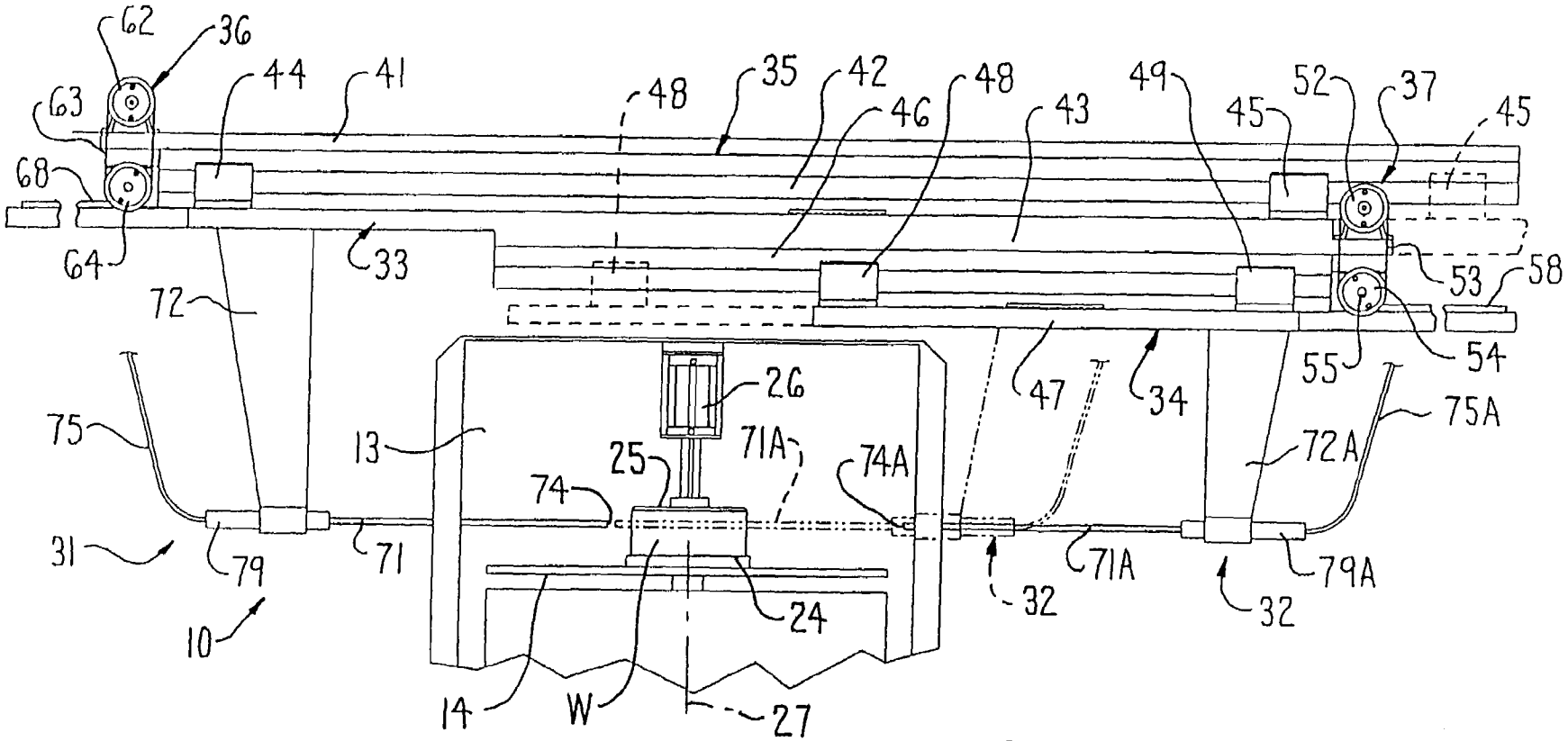
FIG. 4 is an fragmentary side elevational view of the improved surface treatment apparatus according to the present invention.

As illustrated by FIG. 4, the workpiece W which is to be treated is secured by means of a fixture including a lower fixture plate 24 which is fixed to and rotates with the table 14 about its axis 27, the table 14 having a pair of these bottom fixture plates 24 mounted thereon adjacent diametrically opposite sides of the turntable. The fixturing arrangement also includes a top fixture plate 25 which is secured to and vertically movable by means of an actuator 26, such as a fluid pressure cylinder, whereby the workpiece W which is positioned within the treating chamber is fixedly held between the bottom and top fixture plates 24 and 25, respectively.

Figure 5:
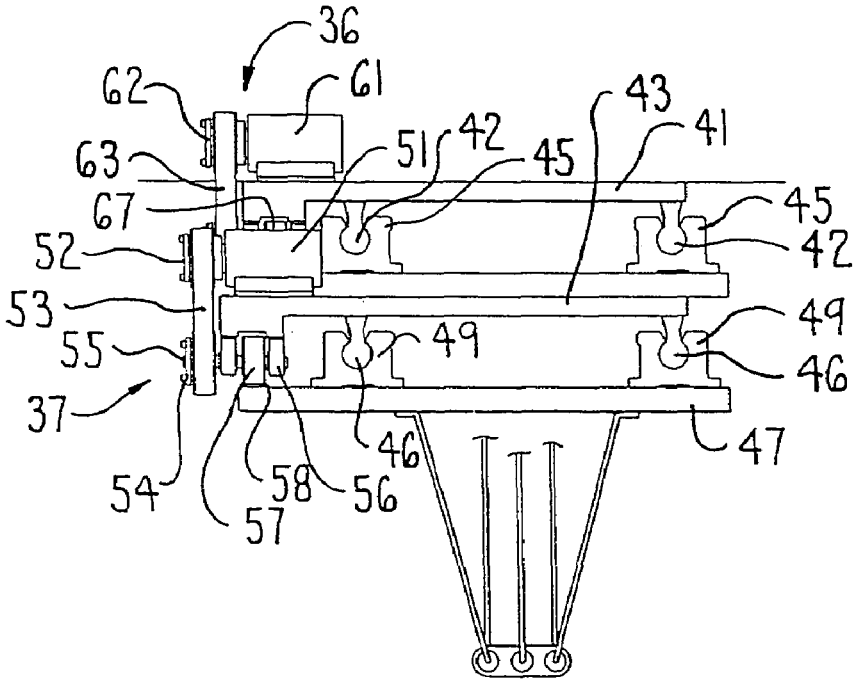
FIG. 5 is an end elevational view of the apparatus of FIG. 4.
Figure 6:
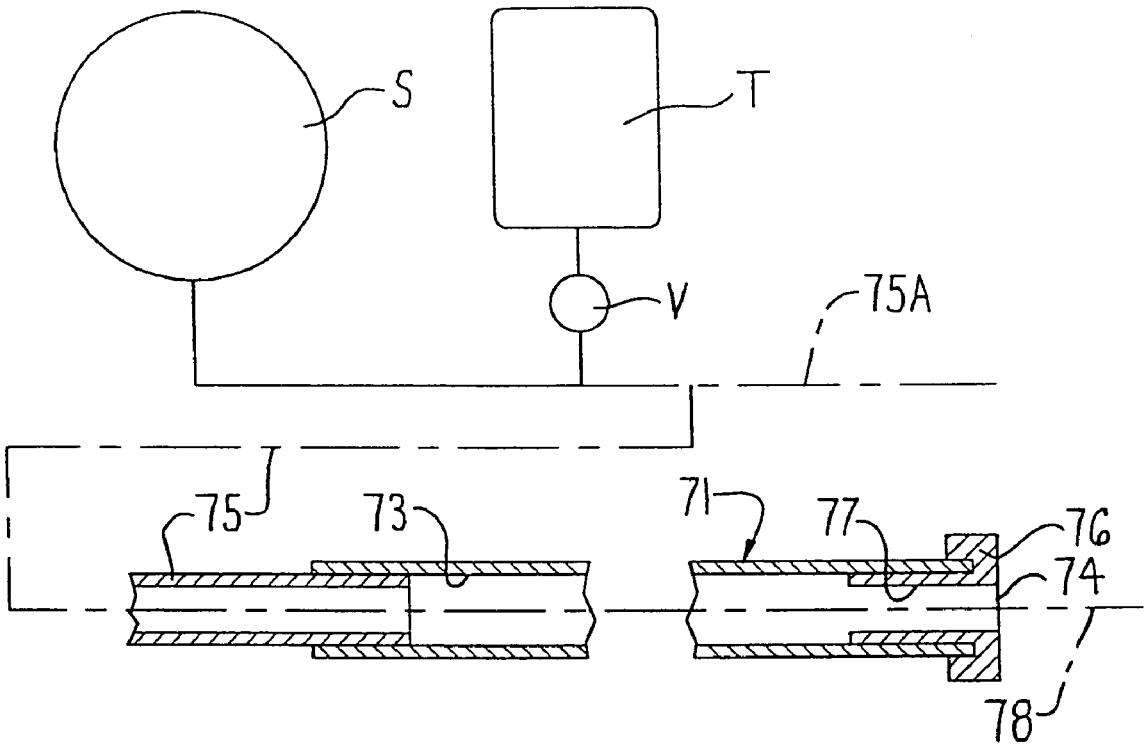
FIG. 6 is a diagrammatic view of the supply system for the nozzle members.

Considering now the surface treating apparatus 10 and referring specifically to FIGS. 4–6, this apparatus includes first and second nozzle assemblies 31 and 32, respectively, which are disposed adjacent opposite sides of the treating chamber 13 and are oriented generally toward one another. The first nozzle assembly 31 is secured to and moves with a first support assembly 33, and the second nozzle assembly 32 is secured to and moves with a second support assembly 34, the latter being slidably supported on the first support assembly 33. The first support assembly 33 in turn is slidably supported on a stationary guide structure 35. The slidable supportive relationship between the supports 33 and 34 and guide structure 35 is such as to permit the first support 33 to be slidable generally horizontally in FIG. 4, and the second support 34 is also supported on the first support assembly for generally horizontal reciprocating movement, whereby the support assemblies 33 and 34 thus are each linearly slidable in generally parallel relationship to one another, with the direction of movement in the illustrated embodiment being generally horizontal.

The reciprocating or back-and-forth sliding movement of the first support member 33 is controlled by a first drive unit 36 which is drivingly coupled between the first support unit 33 and the stationary guide structure 35. In a similar manner the second support unit 34 is slidably moveable relative to the first support unit 33 by a second drive unit 37 which is drivingly connected between the first and second support assemblies 33 and 34.

As illustrated in FIGS. 4 and 5, the stationary guide structure 35 includes a stationary support member 41 which is horizontally enlarged and which, on the underside thereof, mounts a pair of sidewardly spaced and generally parallel guide rails 42 which are horizontally elongated. These latter guide rails provide a slidable coupling with the first or primary support assembly 33 which includes a horizontally enlarged primary slide member 43 which is positioned below the support member 41 and mounts thereon, adjacent opposite ends thereof, sidewardly spaced pairs of support guides 44 and 45, the latter being disposed for linear slidable engagement with the guide rails 42. The slide guides 44 and 45 are preferably formed generally equivalent to recirculating ball slides, such being conventional and well known, to facilitate low-friction linear movement of the guides 44 and 45 along the guide rails 42.

The primary slide member 43 also has a pair of sidewardly spaced and generally parallel guide rails 46 mounted thereon and projecting downwardly therefrom. These guide rails 46 are also horizontally elongated, and extend in generally parallel relationship to the upper guide rails 42.

The second or secondary support assembly 34 also includes a horizontally enlarged secondary guide member 47 which, adjacent opposite ends thereof, mounts sidewardly-spaced pairs of slide guides 48 and 49, the latter being disposed in linear sliding engagement with the guide rails 46. The slide guides 48 and 49, like the slide guides 44 and 45 discussed above, are preferably recirculating ball slide units to facilitate low friction horizontal linear movement of the secondary slide member 47 relative to the primary slide member 43.

The second drive unit 37 which effects linear reciprocating movement of the secondary support assembly 34 includes a drive motor 51 which is mounted on the primary support member 41. The drive motor 51, which may comprise an electrically-driven servomotor, has a driving pulley 52 fixed on the motor shaft, and effects driving of a drive belt 53 which in turn effects rotation of a driven pulley 54. Both the drive belt and the pulleys may be toothed if desired to provide greater control over the rotation. The driven pulley 54 is secured to a drive shaft 55, the latter being rotatably supported by bearings 56 which are mounted to the underside of the primary slide member 43. This rotary shaft 55 mounts thereon a driving wheel or gear 57, the latter being engaged with the upper surface 58, such as an elongate gear rack, which is fixed to the secondary slide member 47. Rotation of drive motor 51 thus causes the secondary slide member 47 to be linearly and, in the alternate embodiment, substantially horizontally slidably displaced.

The first drive unit 36 which drivingly connects between the stationary support member 41 and the primary slide member 43 is of similar construction in that it includes an electric drive motor 61 which is mounted on the stationary member 41, and the drive motor pulley 62 drives a driven pulley 64 through a belt 63. The shaft of pulley 64 is rotatably carried on the underside of the support member 41 and mounts thereon a driving wheel or gear 67 which is engaged with an upper surface or gear rack 68 associated with the primary slide member 43 to effect linear movement of the primary slide in response to energization of the drive motor 61. The overall arrangement of the first drive unit 36 is substantially identical to that of the second drive unit 37, whereby further description thereof is believed unnecessary.

The drive motors 51 and 61 both of which in the illustrated embodiment are reversibly rotatable, are energized and controlled by a suitable control unit (not shown) such as a microprocessor or the like, preferably a programmable unit so as to permit the controlling of the primary and secondary slides, such as controlling speeds, timing and magnitude of displacement, to be adjusted to provide optimum performance relative to the treating operation being carried out.

Considering now the nozzle assemblies 31 and 32, these assemblies are substantially identical to one another except that the nozzle assembly 31 is mounted on and carried with the primary slide member 43, whereas the secondary nozzle assembly 32 is mounted on and carried by the secondary slide member 47.

The nozzle assembly 31, as illustrated by FIG. 4, includes at least one elongate nozzle member 71 formed generally as an elongate tube which is mounted within a holder 79, the latter in turn being secured to a lower end of a support bracket 72. The bracket 72 is fixed to and cantilevered downwardly from the primary slide member 43. The nozzle member 71, as illustrated by FIG. 6, has an elongate flow passage 73 which extends coaxially throughout the nozzle member and which terminates at a nozzle or discharge opening 74 at one end thereof. A conduit 75 connects to the other end of the nozzle member for supplying pressurized blasting media (i.e., a pressurized carrier fluid having solid abrasive particles entrained therein) to the nozzle member. The other end of the conduit connects to a suitable pressurizing source S as well as a supply tank T for the abrasive particles.

The nozzle member 71 may be provided with a hollow tip member 76 constructed of a hard and low-wearing material, such as tungsten or silicon carbide or the like, so as to minimize wear created by discharge of the blasting media therethrough. This tip member 76 has a discharge passage 77 therethrough which constitutes an extension of the nozzle discharge passage 73, with the actual nozzle discharge opening 74 being defined at the end of the tip member. The passage 77 through the tip member 76 is preferably elongated along the flow axis 78, and also has a generally elongate cylindrical configuration, or possibly even a slightly converging configuration as the passage projects to the opening 74, so that the pressurized abrasive media upon discharge through the opening 74 will be maintained in a confined stream which, for at least a selected distance outwardly away from the opening 74, will remain generally cylindrical and hence will experience only minimal radial outward dispersion.

The second nozzle assembly 32 is, as noted above, identical to the first nozzle assembly 31 and hence the parts thereof are identified using the same reference numerals but with the addition of an "A" thereto. The support bracket 72A for the nozzle assembly 32 has the upper end thereof secured to the secondary slide member 47. Further, the nozzle assemblies 31 and 32 are disposed so that they are positioned on opposite sides of the treating chamber 13 and are positioned in generally facing or opposed relationship to one another, with the nozzle members 71 and 71A being disposed in opposed and aligned relationship in that the nozzle axes 78 and 78A are substantially aligned.

Figure 7:
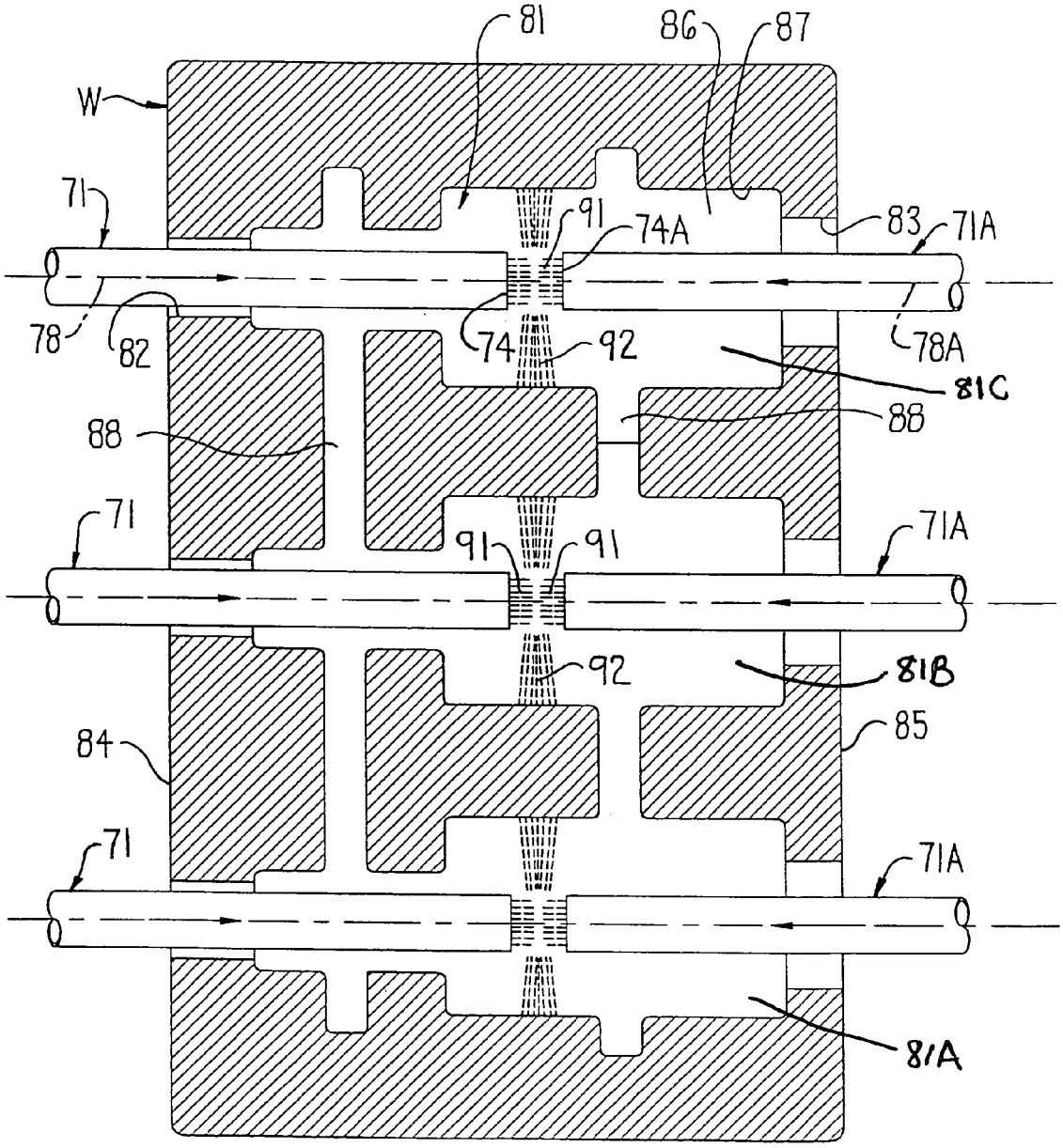
FIG. 7 is a diagrammatic cross sectional illustration of a workpiece and the interior surface treatment thereof by the process and apparatus of the present invention.

In the illustrated arrangement, each of the nozzle assemblies 31 and 32 can be provided with a plurality of individual nozzle members 71 and 71A positioned in sidewardly adjacent and parallel relationship, with each nozzle member having its own supply conduit 75, 75A connected thereto. FIGS. 5 and 7 each illustrate the nozzle assembly having three nozzle members associated with the respective assembly and positioned in side-by-side relationship.

With the arrangement as described above, each of the primary and secondary slide members 43 and 47 can be independently slidably displaced by energization of the appropriate motor 61 or 51, respectively, although this arrangement results in synchronous displacement of the primary and secondary slides whenever only the motor 61 is energized.

When in a non-operational position, the slides and the nozzle assemblies mounted thereon will be positioned generally as illustrated in FIG. 4, in which position, the nozzle member 71 is withdrawn from the workpiece W and the other nozzle member 71A is generally retracted from the treating chamber 13 so as to enable the turntable 14 to be rotated, such as through 180°, to move the workpiece from the exterior loading-unloading station to the interior treating station. When the workpiece is positioned in the treating station, then the drive motor 51 is energized so that nozzle 71A is moved inwardly into the treating station and into an access opening formed in the workpiece W so as to traverse the interior chamber thereof, as described in greater detail hereinafter, until the opposed nozzles 71 and 71A are disposed with their discharge openings 74 and 74A in closely adjacent but slightly spaced relationship. When in this position, the motor 51 is de-energized and thus independent linear displacement of secondary slide member 47 is prevented. Thereafter motor 61 is energized so that primary slide 43 is linearly slidably displaced, which in turn causes the secondary slide to move synchronously therewith, whereupon both nozzle assemblies are displaced transversely relative to the workpiece. The motor 61 can be alternately reversely energized to cause the primary slide member 43, as well as the secondary slide member 47 carried thereon, to be linearly moved in a back-and-forth manner so that the tips of the nozzles effectively traverse, in a back-and-forth fashion, the interior chamber of the workpiece.

More specifically, and referring to FIG. 7, there is diagrammatically illustrated a horizontal cross section of the workpiece W having an interior chamber 81 formed therein, and into which project the ends of the opposed nozzle members 71 and 71A, the latter being disposed with the opposed discharge openings 74 and 74A thereof in closely adjacent but spaced relationship. The spacing (i.e. gap) between the discharge openings 74 and 74A in the blasting position is typically a small distance such as no more than about than one inch, with this distance or spacing between the opposed discharge openings 74 and 74A more typically being in the range of about one-half inch or less. In fact, for many applications, it is contemplated that the spacing (i.e. gap) between the discharge openings will be in the range of from about 0.100 to about 0.300 inch. In some applications, however, the spacing between the opposed discharge openings 74 and 74A may be several inches in magnitude.

In the workpiece W, such as a cast housing for a valve assembly employing multiple shiftable valve spools, the interior chamber 81 includes a main chamber portion 86 which at opposite ends communicates with aligned access openings 82 and 83 as formed in the opposed side walls 84 and 85, respectively, of the workpiece. This main chamber portion 86 is surrounded by boundary walls 87. The interior chamber 81 also includes branch chamber portions 88 which project transversely from the main chamber portion 86 and hence are not directly accessible from the access openings 82–83. In the illustrated embodiment the interior chamber 81 of the workpiece includes a plurality of similar main chamber portions 86 which are disposed in sidewardly spaced relationship within the workpiece, and each of which is accessible through its own access openings 82–83, with branch chamber portions or passages 88 extending transversely between and providing flow interconnection between adjacent main chamber portions 86.

With the arrangement illustrated in FIG. 7, the pairs of opposed nozzle members 71, 71A are moved through a stroke which is selected based on the workpiece and the desired surface treatment operation, which stroke will typically substantially equal the length of the main chamber portion 86 or may extend from a position adjacent the outer end of one access opening 82 to a position adjacent the outer end of the other access opening 83 if treatment of the access openings is desired. The nozzle members may be synchronously linearly moved back and forth through a selected number of cycles due to reciprocating movement of the primary slide member 43 caused by driving rotation of the motor 61. During this back-and-forth movement, the pressurized blasting media is supplied to each opposed pair of nozzle members 71–71A, each of which emits from the respective discharge opening a generally confined high-velocity stream 91, as defined by the high-velocity carrier fluid (such as gas or liquid) having small solid abrasive particles entrained therein. Due to the opposed and close proximity of the discharge openings of the opposed nozzle members, the two streams 91 are directed toward one another and directly violently impact one another shortly after discharge from the respective nozzle members, which impact causes the streams of blasting media to be deflected radially outwardly in a rather confined annular pattern 92 which surrounds the discharged streams 91, with the blasting media in this annular pattern still being at high velocity so that the blasting media and specifically the abrasive particles entrained therein are impacted against the surrounding boundary walls of the main chamber portion 86. Due to the synchronized linear movement of the opposed nozzles 71 and 71A, the radial stream pattern 92 is progressively moved linearly along the boundary wall so as to effect cleaning and treating thereof due to the impacting of the abrasive media thereagainst. At the same time, this movement of the nozzles and of the radial stream pattern 92 causes the high velocity blasting media to enter into the transverse chambers or passages 88 so as to flow therethrough so as to effect cleaning and treating of the boundary walls thereof. The flow of the blasting media into these transverse passages 88 results in impingement of the high velocity blasting media against the side walls of the branch passages 88 due to the somewhat random orientation of the blasting media as it is deflected outwardly, and additionally due to the movement of the nozzle members and the corresponding translation of the annular spray pattern 92 along the main chamber portion 86 in response to the nozzle member movement. In addition, in situations where additional treatment of branch passages or enlargements along the main passage is desired, the timing and/or speed of movement of the nozzle members can be appropriately programmed to permit the nozzle members to either momentarily pause and/or move at a slower rate so as to provide more intensive surface treatment at selected locations along the travel path.

When the nozzle assemblies incorporate two or more nozzle members associated therewith, each opposed pair of nozzle members 71–71A can be positioned for cooperation with one portion of the workpiece interior cavity, and another opposed nozzle pair positioned for cooperation with a further portion so as to permit simultaneous treating of the entire cavity. This is illustrated in FIG. 7 wherein the workpiece is depicted as having three main chamber portions 86 transversely interconnected by passages, with each main chamber portion accommodating therein an opposed pair of nozzle members 71–71A so that each nozzle assembly hence has three sidewardly spaced nozzle members to permit simultaneous treatment of the entire cavity of the workpiece.

A further embodiment of a workpiece finishing machine 110 according to the present invention is illustrated in FIGS. 8–13 and is described hereinafter.

Figure 8:
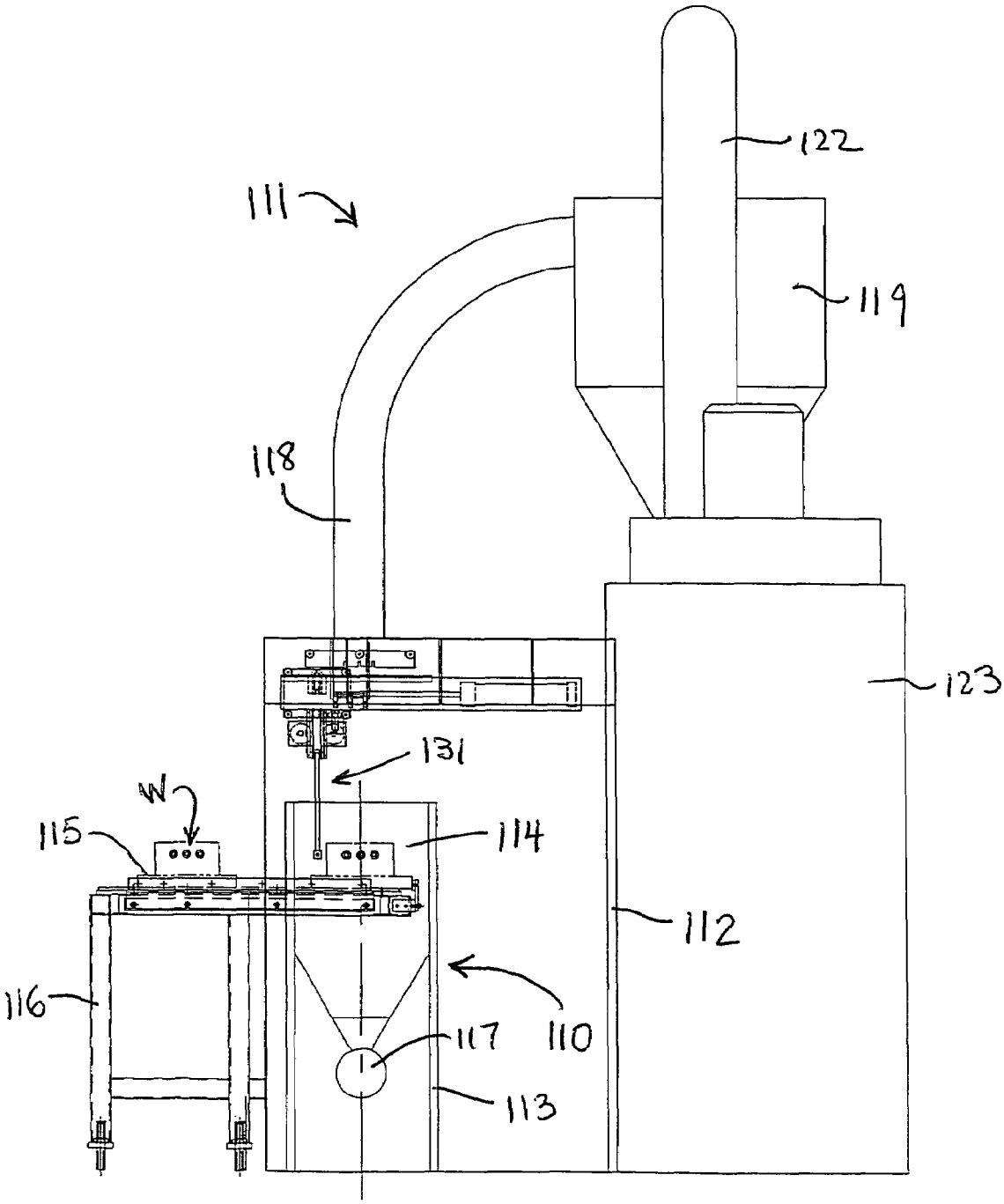
FIG. 8 is an end elevational view of a second embodiment of a work finishing station according to the present invention.
Figure 9:
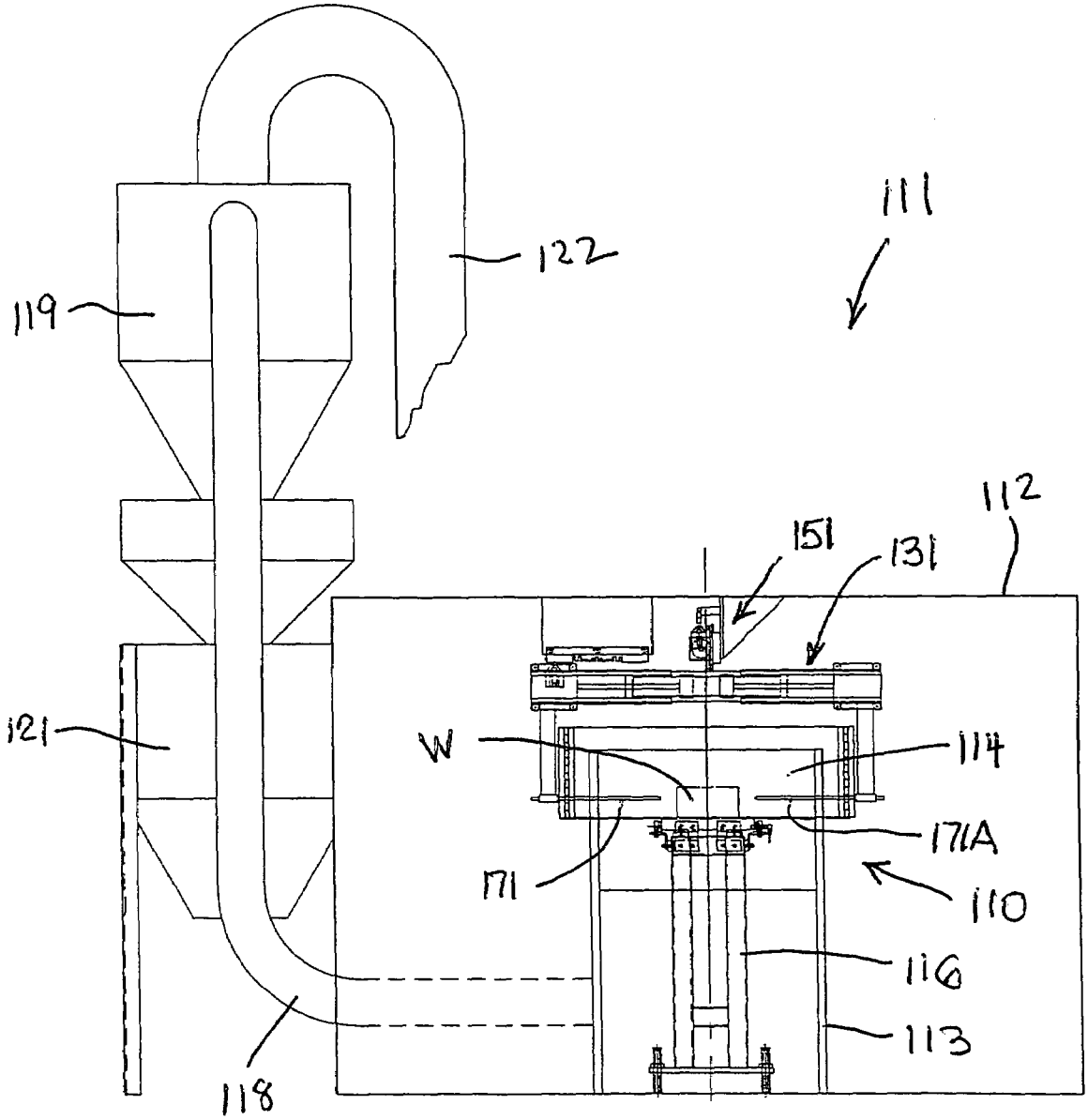
FIG. 9 is a front elevational view of the arrangement shown in FIG. 8.

More specifically, as illustrated by FIGS. 8–9, the surface treating or finishing machine 110 is part of an overall workpiece finishing station 111. The surface treatment machine 110 includes an outer housing or cabinet 112 which effectively encloses the machine, and positioned interiorly thereof is a interior housing or cabinet 113 which defines therein a treating chamber 114. A sliding workpiece-holding fixture 115 mounts thereon a suitable workpiece W so as to permit the workpiece to be moved from a blasting position disposed within the blasting chamber, to an external position permitting mounting and removal of the workpiece. The workpiece support slide is mounted on a suitable support frame 116 which is positioned adjacent the front side of the exterior cabinet and is fixedly related thereto so as to permit the workpiece support slide to access the treating chamber 114.

The bottom of the inner cabinet 113 defines therein, below the treating chamber, a collection hopper 117 for the abrasive and other solid material, from which the collected material is fed through a conduit 118 to a separator 119 such as a cyclone separator. The unwanted debris and other solid matter is discharged downwardly into a collector hopper 120, whereas the particulate abrasive media is separated and sent through a conduit 122 so as to be resupplied to a chamber or compartment 123 from which it can again be entrained in a supply of pressurized carrier fluid and resupplied to the surface treating apparatus 110 for treating a workpiece.

The workpiece W as supplied to the treating chamber 114 may be secured to the support slide 115 by any conventional fixturing structure, whereby further description thereof is believed unnecessary.

The surface treating apparatus 110 also includes a movable support mechanism 129 which is positioned within the outer cabinet 112 and which mounts thereon at least one pair of opposed blasting nozzles which project into the blasting chamber 114 to permit treatment of the workpiece therein, as explained below.

Figure 10:
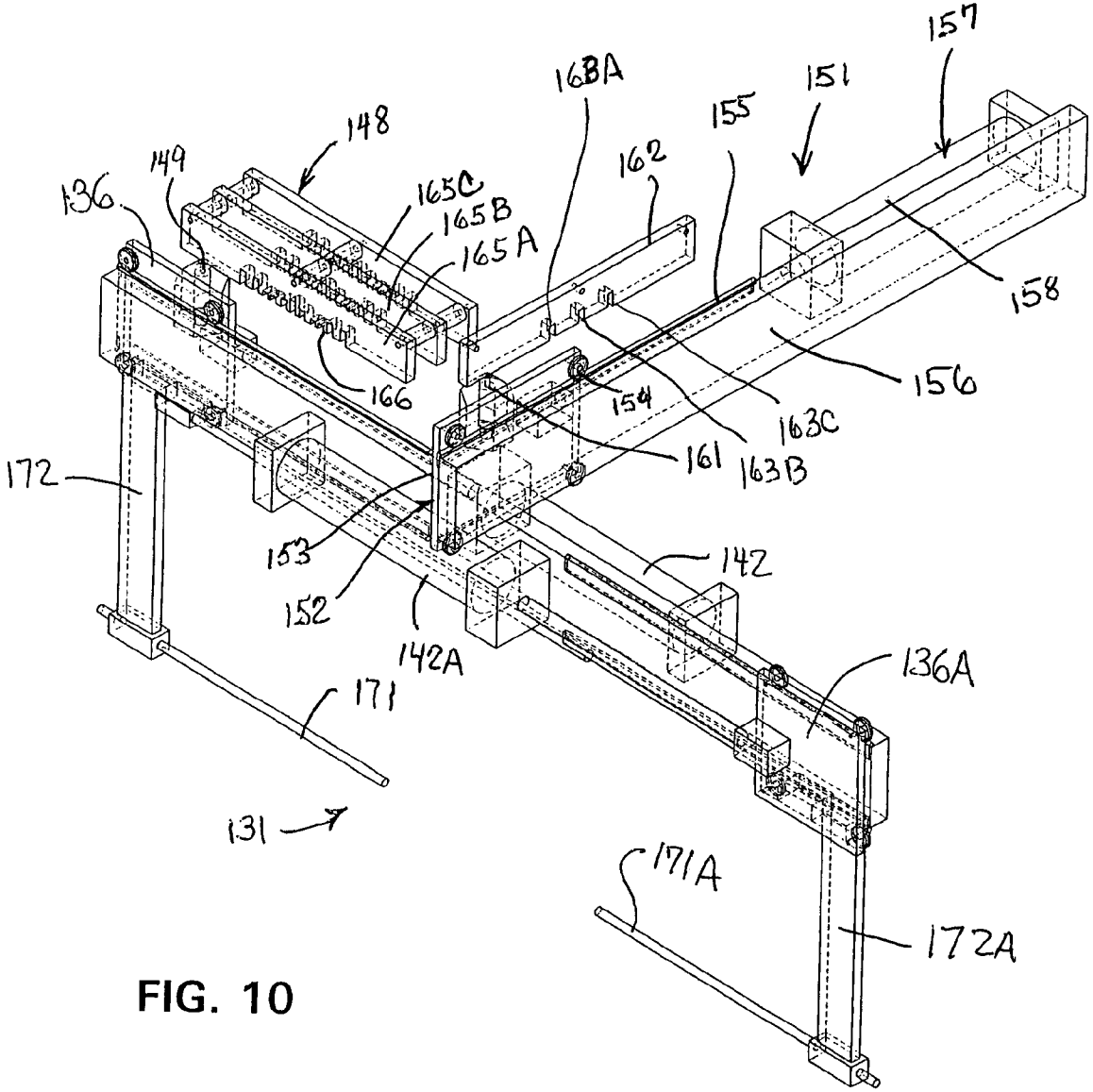
FIG. 10 is a perspective view of the nozzle supporting and moving mechanism associated with the embodiment of FIGS. 8–9.
Figure 11:
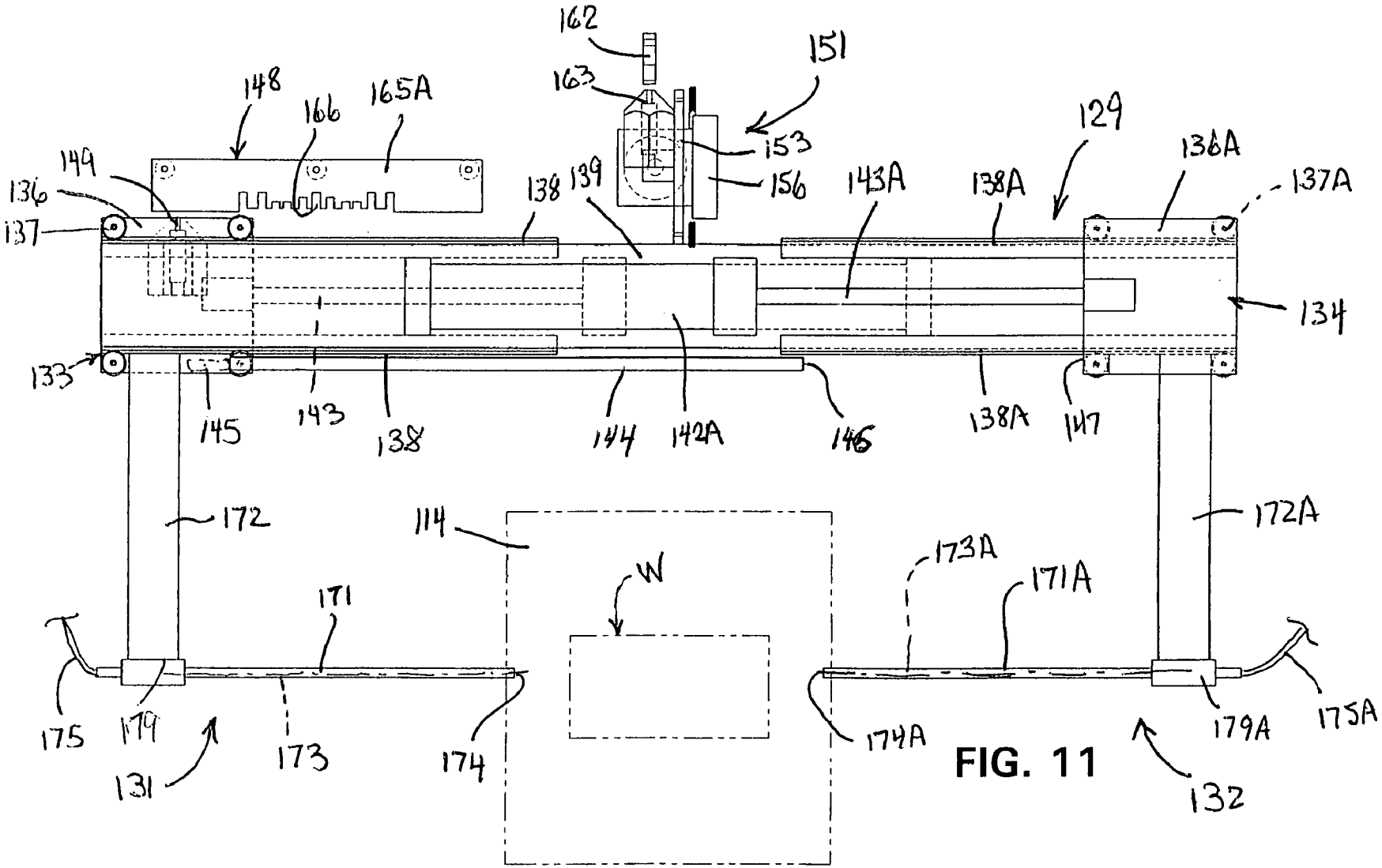
FIG. 11 is a front view of the mechanism shown in FIG. 10.
Figure 12:
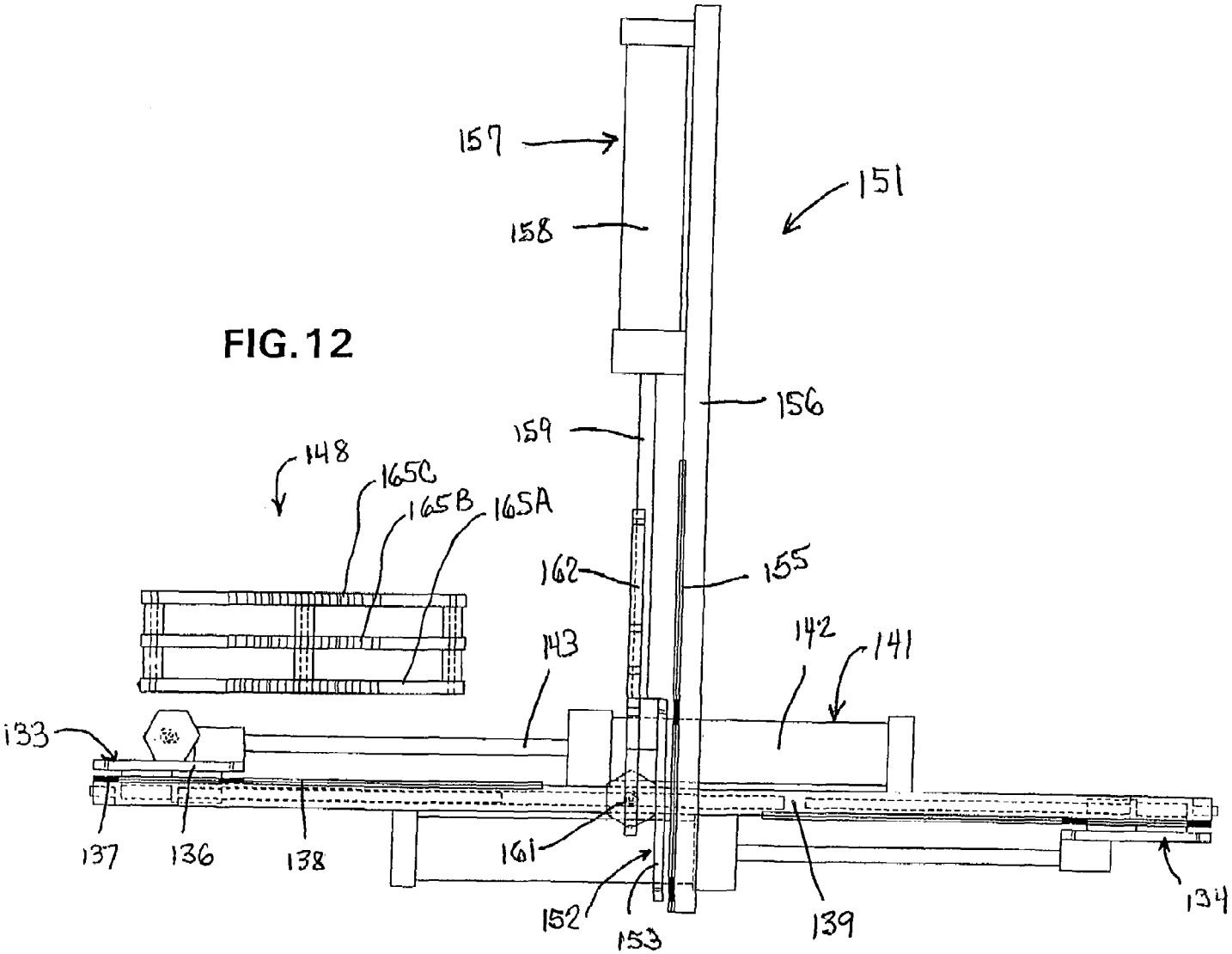
FIGS. 12 and 13 are respectively top and right side views of the mechanism shown in FIG. 11.
Figure 13:
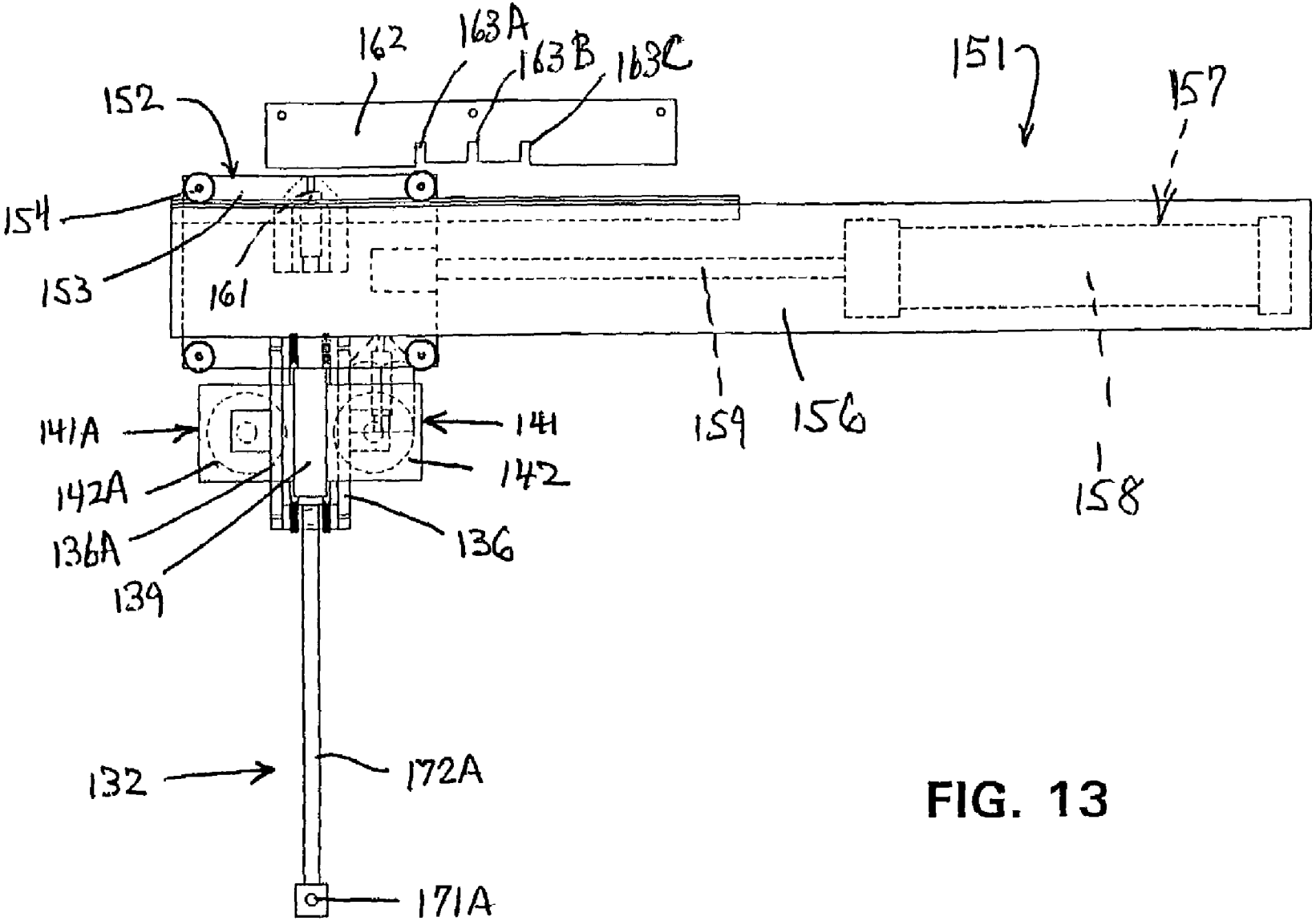

More specifically, and as illustrated in FIGS. 10–11, the nozzle supporting mechanism 129 mounts thereon a pair of opposed nozzle assemblies 131 and 132, the latter being respectively connected to first and second moving supports 133 and 134.

The first or primary support 133 is defined generally by a platelike carriage 136 having rollers 137 on the corners thereof, the latter being disposed in rolling engagement with elongate upper and lower rails 138 which extend along edges of a generally horizontally elongate support track 139.

The support 133, and the nozzle assembly 131 carried thereby, is horizontally linearly movable by a drive unit 141 such as a fluid pressure cylinder. The latter has its housing 142 fixedly mounted on one side of the support track 139, and the piston rod 143 projects outwardly from the housing and has its free end coupled to the carriage 136. The direction of extension/contraction of drive cylinder 141, and the extension of the piston rod 143, is parallel to the elongate direction of the support track 139, and in the illustrated embodiment is substantially horizontal.

The support 133 mounts thereon an elongate stop member 144 and, at one end, is joined by an adjustable connecting structure 145 to the carriage 136. The stop member 144 is defined generally as a horizontally elongate rodlike member which projects generally parallel with the horizontally elongate direction of the support track 139, with the rodlike member 144 projecting toward the opposed support 134 and terminating at its free end in a stop surface 146.

The second or secondary support 134, which carries thereon the nozzle assembly 132, is of similar construction in that it includes a carriage 136A having corner rollers 137A engaged with upper and lower rails 138A which extend along the upper and lower edges of the horizontally elongate support track 139. A further drive unit, namely a pressure cylinder 141A, has its housing 142A fixed to the support track 139 and its piston rod projecting outwardly in parallel relationship with the horizontally elongated direction of the support track, with the free end of piston rod 143A being coupled to the carriage 136A. The carriage 136A defines thereon an abutment surface 147 which is adapted to be moved into contact with the stop surface 146.

The nozzle assembly 131 includes a nozzle member 171 formed by an elongate hollow pipe or tube of generally cylindrical cross section and having a bore or flow passage extending coaxially therethrough generally along the axis 173 of the nozzle member. This nozzle member 171 at its one free end terminates in a discharge nozzle or opening 174, and at its other end is coupled to a suitable conduit 175 which in turns joins to a suitable supply source for supplying a blasting fluid, with entrained abrasive media, to the nozzle member. The nozzle member 171, at a location spaced from discharge end 174, has a mounting hub 179 which connects to one end of an upright bracket 172, the latter being fixed to the respective carriage 136.

The other nozzle assembly 132 is of substantially identical construction and hence the parts thereof are designated by the same reference numerals with the addition of an "A" thereto.

The nozzle members 171 and 171A are oriented so as to be disposed in aligned and opposed relationship, that is, the centerlines 173 and 173A are aligned with one another, and the nozzles face one another so that the discharge openings 174 and 174A are disposed in opposed aligned relationship so as to directly face one another.

Each of the nozzle members 171 and 171A is preferably defined by a hollow tubular or pipelike member of cylindrical cross section and having a length which is large relative to the diameter of the discharge opening 174, 174A. The length of the nozzle members 171 and 171A, which length typically is about 8 inches or more, ensures that the blasting fluid with entrained abrasive media has an opportunity to attain the desired velocity and to effect proper control over the blasting fluid during its passage through the elongate length of the nozzle member so as to result in the blasting fluid with entrained abrasive media, upon discharge from the discharge end of the nozzle, being closely confined into a generally cylindrical discharged stream, whereby radial diffusion of the discharge stream is believed minimized.

To control the movement speed of the nozzle members when they traverse an interior passage of a workpiece, and to additionally permit the movement speed of the nozzles to be varied over selective lengths of the workpiece passage being traversed, the nozzle supporting mechanism 129 cooperates with a speed control arrangement 148. The latter is stationarily positioned in close proximity to the movable support 133, and the latter has a sensor or follower 149 thereon which cooperates with the speed controller 148 during movement of the carriage 136 so as to control the speed of the nozzle members, as defined in greater detail hereinafter.

The nozzle supporting mechanism 129 is in turn carried by and is transversely displaceable in a direction perpendicular to the nozzle movement direction by means of a transverse shifting mechanism 151. The latter includes a movable support 152 defined by a carriage 153 having rollers 154 at the corners thereof, the latter being in rolling engagement with upper and lower elongate rails 155 which are secured to and extend longitudinally along upper and lower edges of a horizontally elongate stationary track 156. The track 156, and the guide rails 155 thereon, extend generally horizontally in substantially perpendicular relationship to the horizontally extending direction of the track 139 and hence perpendicular to the nozzle movement direction. The track 156 is fixedly positioned in a suitable manner, such as by being secured adjacent opposite ends thereof to the sidewalls of the outer cabinet 112.

The transverse shifting mechanism 151 includes a driving unit 157, preferably an extendable/contractable fluid pressure cylinder, the latter having its housing 158 secured to the support track 156. The piston rod 159 of the pressure cylinder 157 projects outwardly from the housing generally parallel to the elongate direction of the support track 156, and the remote or free end of the piston rod 159 is connected to the carriage 153 so as to control the reciprocating movement thereof lengthwise along the support track 156.

The carriage 153 mounts thereon a follower or sensor 161 which cooperates with a position controller 162 which is stationarily positioned adjacent and extends generally parallel with the direction of movement of the carriage 153. The position controller defines thereon a plurality of position defining structures, such as the three position defining slots designated 163A, 163B and 163C. These position defining slots cooperate with the follower or sensor 161 during movement of the support 152 so as to permit transverse horizontal shifting of the nozzle supporting mechanism 129 carried by the support 152 to thereby permit the nozzle supporting member 129 to be positioned in one of several different discrete operational positions as defined by the different slots 163. The providing of three slots as in the illustrated embodiment is intended to permit the nozzle supporting mechanism 129, and the nozzles carried thereby, to be positioned in three discrete transversely-spaced positions, each of which enables the nozzles to cooperate with different discrete interior passage associated with a workpiece.

In addition, the speed controller 148 as briefly discussed above is defined by a plurality of individual speed control panels or tracks as designated lESA, 165B and 165C, each having a timing track 166 extending longitudinally along an edge thereof and positioned for cooperation with the follower or sensor 149. The individual speed control tracks or panels 165A through 165C are disposed in parallel but spaced transverse relationship relative to the direction of nozzle movement, and in particular are transversely spaced so that when the follower 161 associated with the shifting mechanism support 152 is respectively engaged in the slots 163A, 163B and 163C, the follower 149 as provided on the nozzle support 133 is positioned for engagement with the speed control panels 165A, 165B and 165C respectively.

The timing track 166 as associated with each of the speed control panels may be designed so as to provide the desired control over both the speed, the variation of the speed, and the travel distance of the nozzles as they traverse lengthwise of the respective interior workpiece passage. In this regard, the timing track 166 enables the speed of the nozzles to be varied during the stroke thereof, such as by varying the speed of movement of the driving piston rod 143 by controlling the supply of pressure fluid to the driving cylinder 141. In this manner, the speed of the nozzles can be varied at various points along the stroke, and for various lengths along the stroke, so as to permit control over the abrasive blasting which occurs within the workpiece as the nozzles traverse along the passage. In this manner the intensity of the abrasive blasting which occurs as the nozzles traverse the workpiece passage can be suitably adjusted so as to provide increased blasting time in those areas which are more difficult to surface treat, while at the same time permitting reduced blasting time in those regions of the workpiece passage which require less surface treatment.

Controllers similar to the speed control panels 165 are well known, so that further detailed description thereof is believed unnecessary.

The operation of the surface treatment machine 110 will now be briefly described so as to supplement the structural descriptions presented above.

The machine 110 is particularly desirable for permitting sequential surface treating of multiple interior passages or chambers associated with a single workpiece, and in particular is illustrated for permitting sequential surface treating of three discrete chambers in a workpiece, such as the passages or chambers designated 81A, 81B and 81C in FIG. 7.

With the workpiece W mounted on the support slide 115 and positioned within the finishing chamber 114, and with the machine being generally in the start up position illustrated by FIGS. 10–13, the pressure cylinder 157 associated with the transverse shifting mechanism is energized so as to shift the carriage 153, and the nozzle support mechanism 129 carried thereby, transversely until the sensor 161 aligns with the position locator 163A. The pressure cylinder 157 is stopped so as to stop the carriage 153 in this position wherein the opposed nozzle members 171 and 171A are in aligned relationship with the interior passage or chamber 81A of the workpiece.

The rightward end of pressure cylinder 143A is then energized so as to pull the support 134 inwardly (i.e. leftwardly) until the carriage 136A abuts the stop surface 146. During this inward pulling of the support 134, the nozzle 171A projects into and traverses along the length of passage 81A and, upon contact with the stop surface 146, the nozzle tip l74A is disposed closely adjacent and is spaced from the opposed nozzle tip 174 by a very small gap, typically in the range of 0.100 to 0.300 inch. The rightward end of drive cylinder 142A is then connected to exhaust, and the leftward end of drive cylinder 142 is energized so as to drive the support 133 rightwardly along the track 139, thereby causing the nozzle 171 to enter into and pass lengthwise along the interior passage 81A. During this latter movement, the engagement of the stop surface 146 against the abutment surface 147 on carrier 136A causes the nozzle member 171A to move synchronously with the nozzle 171 along the length of the passage 81A while maintaining the predefined gap between the opposed nozzle tips 174 and 174A.

During the aforementioned movement, the sensor or follower 149 associated with carriage 136 moves into contact with the time track 166 and hence effects initiation of flow of blasting media to the opposed nozzles 171 and 171A. As the movement of the nozzles through the passage 81A continues, the sensor senses the variations in the timing track 166 and hence causes the speed of movement of the nozzles to be appropriately varied according to the predefined program. For example, the speed of the nozzles will typically be slowed down when the gap between the nozzle tips is moving through that portion of the passage 81A which communicates with the transverse passages 88 so as to provide for more intensive surface treatment of the transverse passages. Similarly, the timing track may also effect slowing down of the nozzle speed when the nozzle tips move from a small diameter cross section of passage 81A into a larger diameter portion of the passage so as to permit more intensive surface treating in view of the increased surface area and greater spacing of the walls from the nozzle tips. The actual programming of the nozzle speed and variations thereof will obviously take into account the overall configuration of the interior passage being finished, and the regions thereof which require more intensive surface treatment. Upon reaching the far end of the passage 81A (the rightward end in FIG. 7), the sensor 149 will sense the end of the timing track 166 so as to effectively shut off flow of abrasive media to the nozzles, and substantially simultaneously the drive cylinders 142 and 142A will both be appropriately energized so as to retract both nozzles 171 and 171A back to their initial positions wherein they are extracted from the workpiece as illustrated in FIG. 11.

The shifting cylinder 157 is then energized to transversely shift the carriage 153 and the nozzle support mechanism mounted thereon transversely into engagement with position locator 163B, whereupon the nozzles 171–171A are now aligned with opposite ends of the interior passage 81B. The blasting of this passage is then carried out in the same manner as described above relative to the passage 81A. During the movement along the passage 81B, however, the sensor or follower 149 now cooperates with a timing track provided on the speed control panel 165B, and hence the motion pattern of the nozzles as they traverse the passage 181B can be uniquely customized for this passage.

After retraction of the nozzles from the passage 81B, they are then stepped over into alignment with the passage 81C and surface treatment thereof is then carried out in accordance with the same process as summarized above. The treatment of the passage 81C, however, results in the follower 149 cooperating with the timing track associated with the speed control panel 165C.

The transverse shifting mechanism can then move the nozzle support mechanism back to its start up position, if desired, and the finished workpiece can be removed from the blasting chamber and a new workpiece then inserted into the chamber so as to permit surface treatment of the interior passages thereof in the same manner as described above.

While the above operational description relates to a single uni-directional pass of the opposed nozzles through each passage, it will be recognized that multiple passes of the nozzles through any selected passage can be achieved if desired by appropriate control programming so that the nozzles are reciprocated back and forth within the selected interior passage. In view of the programmable speed control associated with the nozzles, however, multiple passes of the opposed nozzles through the interior passage is not believed necessary in most instances.

With the aforementioned arrangement, the spacing or gap between the nozzle tips 174 and 174A when in the blasting position, as diagrammatically illustrated in FIG. 7, can be suitably adjusted as desired by adjusting the longitudinal extension of the stop member 144.

It will be appreciated that various controls such as limit switches, computerized programs or programmed logic controllers may be provided so as to control the overall sequence of operation of the nozzle assembly, including the transverse shifting thereof.

In the present invention the blasting media, in one preferred arrangement, utilizes air as the blasting fluid so as to permit desired impacting of the blasted abrasive media against the walls of the chamber while at the same time permitting the air to escape from the chamber through annular clearance spaces which exist where the nozzle members project through the access openings.

The abrasive media may assume many different conventional shapes, sizes and materials and, in one embodiment, may involve small metal balls or shot since experimental testing has indicated that such perform in a desirable manner.

The present invention is believed to provide effective blasting over a wide range of nozzle discharge velocities, which range may vary from as low as from about 30 feet per second up to as high as about 250 feet per second. The actual range which will more commonly be used, however, will be based on the pressure of the available pressurized air which, in typical manufacturing facilities, is about 80 to 90 psi.

In addition, the nozzle members such as illustrated by nozzles 71 and 171 preferably have an overall length which is several orders of magnitude greater than the diameter of the bore or passage extending throughout the nozzle so as to enable the abrasive media, when flowing through the elongate passage of the nozzle, to utilize the high velocity of the carrier fluid (i.e. air) to effect appropriate acceleration of the abrasive particles so that such particles, upon discharge from the nozzle, are traveling at high speed. For example, as one preferred example, the nozzle members preferably has a length such that the straight discharge passage therein will be at least about 8 inches long, whereas the passage may have a diameter of about one-fourth inch or less.

In addition, while it is contemplated that the abrasive particles will already be entrained in the pressurized high-velocity carrier fluid as it is supplied to the nozzle members, such as illustrated by FIG. 6, nevertheless it will be apparent that other nozzle constructions can be utilized, including nozzles which are supplied with the carrier fluid and which, by creation of a vacuum, effect sucking of the abrasive into a mixing chamber of the nozzle so as to entrain the abrasive within the carrier fluid. However, supplying the high-velocity pressurized blasting media (i.e., the blasting fluid with blasting media entrained therein) to the nozzles as in the illustrated embodiment is preferred since this simplifies the nozzle construction and enables the nozzle member to be formed as an elongate but small diameter member so as to permit its penetration into and through the small openings and chambers associated with the workpiece.

With the present invention, the blasting media supplied to the opposed nozzles are provided with equal pressure, and are each provided with abrasive media entrained therein so as to cause the opposed discharged streams to violently directly impact against one another and thereby cause a substantially uniform radially outward annular dispersion of the high-velocity blasting media so as to cause it to impact with high energy against the surrounding walls or penetrate into the transverse chambers and passages. The media may involve a wide variety of particulate solid material, including plastic abrasives, metal grit, glass beads, metal shot and the like, although use of spherical abrasive media may consistently provide higher performance characteristics.

In addition, after the interior chamber of the workpiece has been blasted as described above, the abrasive media which is supplied to and entrained in the blasting streams can be shut off so that solely the pressurized carrier fluid is supplied to the opposed nozzles, which opposed nozzles can still be linearly moved throughout the length of the interior chamber, such as by use of a valve V as shown in FIG. 6, whereupon the carrier fluid can be used to effect flushing of abrasive and debris from the interior chamber.

It will be further appreciated that, while the invention described above utilizes elongate rigid pipelike nozzle members for penetration into the interior chamber of the workpiece, in some situations the elongate rigid nozzle member may be replaced by a suitable flexible conduit or hose having a nozzle tip, such as a carbide tip at the end of the hose for controlling the discharge of the blasting media. Use of such flexible nozzle member may be advantageous in situations where portions of an interior chamber are difficult to access, although use of a flexible hose may result in increased wear problem with respect to confinement of the blasting media.

It will be still further appreciated that the opposed nozzle assemblies can each be independently supported and/or driven. For example, as an alternative to the illustrated embodiments wherein the movable support for one nozzle assembly is movably carried on or moved by the movable support for the other nozzle assembly, it will be appreciated that each nozzle assembly could be provided with its own independent movable support so that each nozzle assembly could be driven independent of the other, with synchronous and simultaneous movement of the two nozzle assemblies so as to maintain uniform spacing between the discharge openings thereof being achieved by simultaneous and synchronous activation of the individual drives for the different nozzle assembly supports so as to effect the desired traversing of the opposed nozzles within the interior chamber of the workpiece during the blasting operation. As a further variation, it is anticipated that the opposed nozzle assemblies could be synchronously and/or independently driven from a single driving source, which driving source would be appropriately interconnected to the opposed nozzle assemblies through separate drive trains which could be appropriately engaged or disengaged so as to provide desired control over the movement of the nozzle assemblies.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A process for treating the boundary walls of an interior chamber formed in a workpiece, comprising the steps of:

providing a workpiece having a plurality of interior chambers which are sidewardly spaced apart and transversely interiorly interconnected, and first and second aligned access openings communicating with opposite ends of each respective interior chamber;

providing pluralities of first and second nozzle members positioned so that each of said first nozzle members is disposed in opposed relationship to a corresponding one of said second nozzle members;

simultaneously inserting all of said first nozzle members into the workpiece and also simultaneously inserting all of the second nozzle members into the workpiece so that each of the opposed pairs of first and second nozzle members is positioned within a respective one of the interior chambers and discharge openings of the opposed first and second nozzle members are positioned closely adjacent and directly opposed to one another;

simultaneously supplying substantially equal streams of pressurized blasting media, as defined by a pressurized carrier fluid having solid abrasive particles entrained therein, to the discharge openings of all of the first and second nozzle members;

simultaneously discharging substantially equal and opposed high-velocity streams of blasting media from said discharge openings so that the discharged streams, almost immediately after discharge, directly impact one another to cause the blasting media to be deflected radially outwardly in a surrounding annular pattern for high energy impact with the boundary wall of the respective interior chamber; and simultaneously moving the nozzle members, while maintaining them in generally fixed relationship to one another, along the respective interior chamber so that the blasting media as deflected radially outwardly into the annular pattern progressively treats the boundary wall of the respective interior chamber.

2. A process for treating the boundary walls of an interior chamber formed in a workpiece, comprising the steps of:

providing a workpiece having a plurality of interior chambers which are sidewardly spaced apart and transversely interiorly interconnected, and first and second aligned access openings communicating with opposite ends of each respective interior chamber;

providing first and second nozzle members with opposed discharge openings;

aligning said first and second nozzles with opposite ends of a first one of said interior chambers and then inserting said nozzles into the chamber with a defined small gap between the opposed discharge openings thereof;

synchronously moving the first and second nozzle members linearly along the chamber while supplying substantially equal streams of pressurized blasting media, as defined by a pressurized carrier fluid having solid abrasive particles entrained therein, to the discharge openings of said nozzle members to simultaneously discharge substantially equal and opposed high-velocity streams of blasting media from said discharge openings so that the discharged streams, almost immediately after discharge, directly impact one another to cause the blasting media to be deflected radially outwardly in a surrounding annular pattern for high energy impact with the boundary wall of the chamber;

thereafter withdrawing the first and second nozzle members from said opposite ends of the first chamber and transversely displacing the first and second nozzle members relative to the workpiece so that the nozzle members align with opposite ends of a second one of said interior chamber; and thereafter inserting the nozzle members into the second interior chamber and effecting treatment of the boundary wall thereof in the same manner as with respect to the first chamber as defined above.

3. A process for treating the boundary walls of an interior chamber formed in a workpiece, comprising the steps of:

providing a workpiece having an interior chamber with a radial outward enlargement along a part of the length thereof, and having first and second aligned access openings which communicate with opposite ends of the interior chamber;

providing first and second substantially identical elongated nozzle members having discharge openings at tip ends thereof;

inserting the first and second nozzle members into the interior chamber through the respective first and second access openings so that the nozzle members are substantially aligned and the discharge openings thereof are positioned in closely adjacent and directly opposed relationship to one another and define an unobstructed gap therebetween;

simultaneously supplying substantially identical streams of pressurized blasting media, as defined by a pressurized high-velocity carrier fluid having solid abrasive particles entrained therein, to the discharge openings of said first and second nozzle members;

simultaneously discharging substantially identical and substantially cylindrical opposed high-velocity streams of blasting media from said discharge openings of said first and second nozzle members so that the discharged cylindrical streams, almost immediately after discharge, directly impact one another within said gap and cause the blasting media of both streams to be deflected radially outwardly in substantially perpendicular relation to the flow direction of the discharged streams to define a surrounding annular pattern for high energy impact with the boundary wall of the chamber in surrounding relationship to the gap; and simultaneously moving the nozzle members, while maintaining them in stationary relationship to one another, lengthwise along the interior chamber parallel to the discharge direction first in one direction and then in the opposite direction while continuing to discharge opposed identical streams of blasting media therefrom so that the blasting media as deflected outwardly into the annular pattern progressively treats the boundary wall of the interior chamber and treats transitional surfaces which join radially between the enlargement and the interior chamber.

4. The process according to claim 3, comprising the step of initially positioning the opposed discharge openings of the first and second nozzle members with a gap therebetween of no more than about one inch.

5. A process according to claim 3, including the step of terminating the entrainment of abrasive particles in the high-volocity carrier fluid while continuing to supply the pressurized carrier fluid to the nozzle members as they are synchronously moved within the interior chamber to effect removal of abrasive particles and debris from the chamber.

6. A process for treating the boundary walls of an interior chamber formed in a workpiece, comprising the steps of:

providing a workpiece having an interior chamber, first and second aligned access openings which communicate with opposite ends of the interior chamber, and at least one passage which communicates with and extends transversely from said interior chamber;

providing first and second substantially identical elongated nozzle members having discharge openings at tip ends thereof;

inserting the first and second nozzle members into the interior chamber through the respective first and second access openings so that the nozzle members are substantially aligned and the discharge openings thereof are positioned in closely adjacent and directly opposed relationship to one another and define an unobstructed gap therebetween;

simultaneously supplying substantially identical streams of pressurized blasting media, as defined by a pressurized high-velocity carrier fluid having solid abrasive particles entrained therein, to the discharge openings of said first and second nozzle members;

simultaneously discharging substantially identical and substantially cylindrical opposed high-velocity streams of blasting media from said discharge openings of said first and second nozzle members so that the discharged cylindrical streams, almost immediately after discharge, directly impact one another within said gap and cause the blasting media of both streams to be deflected radially outwardly in substantially perpendicular relation to the flow direction of the discharged streams to define a surrounding annular pattern for high energy impact with the boundary wall of the chamber in surrounding relationship to the gap; and simultaneously moving the nozzle members, while maintaining them in stationary relationship to one another, lengthwise along the interior chamber parallel to the discharge direction first in one direction and then in the opposite direction while continuing to discharge opposed identical streams of blasting media therefrom so that the blasting media as deflected outwardly into the annular pattern progressively treats the boundary wall of the interior chamber and treats transitional surfaces which join radially between the enlargement and the interior chamber; and modifying the movement of the nozzle members when the gap is substantially aligned with the transverse passage so as to permit the deflected annular pattern of blasting media to enter into and effect surface treating of the transverse passage.

7. A process according to claim 6, wherein the movement of the nozzle members is modified so that the nozzle members pause or move at a slower speed when the gap between the nozzle members is substantially aligned with the transverse passage.

8. A process for treating the boundary walls of an interior chamber formed in a casting, comprising the steps of:

providing a casting having an elongate interior chamber therein which is at least partially closed at opposite ends thereof by respective opposite walls of the casting and having first and second aligned access openings respectively formed in the opposite walls of the casting for respective communication with opposite ends of the interior chamber, said access openings being of smaller cross section than said interior chamber;

providing first and second substantially identical elongate nozzle members having substantially identical discharge openings at tip ends thereof, the elongate nozzle members having a small exterior cross section which substantially uniformly extends from the tip ends of the nozzle members lengthwise thereof over a substantial lengthwise extent so as to permit the nozzle members to be inserted through the access openings;

providing first and second movable supports which engagingly support the nozzle members at a location spaced remote from said tip ends so that the first and second elongated nozzle members are respectively cantilevered outwardly from the first and second supports in generally aligned, opposed and spaced relationship to one another;

positioning said first and second supports on opposite sides of the casting so that the nozzle members are in opposed and aligned relationship with one another with the tip ends of the first and second nozzle members being respectively positioned adjacent and in generally aligned relationship with said first and second access openings;

relatively moving the first and second support members toward one another so as to insert the first and second nozzle members into the interior chamber through the respective first and second access openings so that the nozzle members are substantially aligned and the discharge openings thereof are positioned closely adjacent and in directly opposed relationship to one another and define a small unobstructed gap therebetween, the nozzle members being entirely supported by and cantilevered from the respective supports when positioned within said interior chamber;

simultaneously supplying substantially identical streams of pressurized blasting media, as defined by a pressurized high-velocity carrier fluid having solid abrasive particles entrained therein, to the discharge openings of said first and second nozzle members;

simultaneously discharging substantially identical and opposed high velocity streams of blasting media from said discharge openings of said first and second nozzle members so that the discharged streams, almost immediately after discharge, directly impact one another within said small gap and cause the blasting media of both streams to be deflected outwardly in substantially perpendicular relationship to the flow direction of the discharged streams to define a surrounding annular pattern for high energy impact with a boundary wall of the interior chamber in surrounding relationship to the small gap; and simultaneously moving the nozzle members, while maintaining them in stationary relationship to one another, lengthwise along the interior chamber parallel to the discharge direction so that the blasting media as deflected outwardly into the annular pattern progressively treats the boundary wall of the interior chamber as defined in the casting.

9. The process according to claim 8, comprising the steps of:

initially positioning the opposed discharge openings of the first and second nozzle members with the small gap therebetween of no more than about one inch; and after the boundary wall of the interior chamber has been treated with the abrasive media, terminating the entrainment of abrasive particles in the high velocity carrier fluid while continuing to supply the pressurized carrier fluid to the nozzle members as they are synchronously moved within the interior chamber to effect removal of abrasive particles and debris from the chamber.

10. A process according to claim 8, including the steps of:

providing the casting with at least one interior passage which communicates with and extends transversely from said interior chamber; and modifying the movement of the nozzle members so as to pause or slow the movement of the nozzle members when the small gap is substantially aligned with the transverse interior passage so as to permit the deflected annular pattern of blasting media to enter into and effect surface treating of the transverse interior passage.

11. A process according to claim 8, including the steps of:

providing the interior chamber of the casting with first and second elongate chamber portions which are in aligned communication with one another, said first chamber portion being of smaller cross section and said second chamber portion being of larger cross section; and modifying the movement of the nozzle members as they move lengthwise of the interior chamber so that the nozzle members move at a slower speed when the small gap is disposed in said second chamber portion in comparison to the speed of the nozzle members when the small gap is moved along said first chamber portion.

12. A process for treating the boundary walls of an interior chamber formed in a workpiece, comprising the steps of:

providing a workpiece with an interior chamber having first and second chamber portions in aligned communication with one another, said second chamber portion being of larger cross section than said first chamber portion, and having first and second aligned access openings which communicate with opposite ends of the interior chamber;

providing first and second substantially identical elongated nozzle members having discharge openings at tip ends thereof;

inserting the first and second nozzle members into the interior chamber through the respective first and second access openings so that the nozzle members are substantially aligned and the discharge openings thereof are positioned in closely adjacent and directly opposed relationship to one another and define an unobstructed gap therebetween;

simultaneously supplying substantially identical streams of pressurized blasting media, as defined by a pressurized high-velocity carrier fluid having solid abrasive particles entrained therein, to the discharge openings of said first and second nozzle members;

simultaneously discharging substantially identical and substantially cylindrical opposed high-velocity streams of blasting media from said discharge openings of said first and second nozzle members so that the discharged cylindrical streams, almost immediately after discharge, directly impact one another within said gap and cause the blasting media of both streams to be deflected radially outwardly in substantially perpendicular relation to the flow direction of the discharged streams to define a surrounding annular pattern for high energy impact with the boundary wall of the chamber in surrounding relationship to the gap; and simultaneously moving the nozzle members, while maintaining them in stationary relationship to one another, lengthwise along the interior chamber parallel to the discharge direction so that the blasting media as deflected outwardly into the annular pattern progressively treats the boundary wall of the interior chamber; and modifying the movement of the nozzle members when the gap therebetween moves from said first chamber section into said second chamber section so that the nozzle members move at a slower speed lengthwise of said second chamber section than when moving lengthwise through said first chamber section.

13. A process for treating the boundary walls of an interior chamber formed in a workpiece, comprising the steps of:

providing a workpiece having an interior chamber, and first and second aligned access openings which communicate with opposite ends of the interior chamber;

providing first and second substantially identical elongated nozzle members having discharge openings at tip ends thereof;

inserting the first and second nozzle members into the interior chamber through the respective first and second access openings so that the nozzle members are substantially aligned and the discharge openings thereof are positioned in closely adjacent and directly opposed relationship to one another and define an unobstructed gap therebetween;

simultaneously supplying substantially identical streams of pressurized blasting media, as defined by a pressurized high-velocity carrier fluid having solid abrasive particles entrained therein, to the discharge openings of said first and second nozzle members;

simultaneously discharging substantially identical and substantially cylindrical opposed high-velocity streams of blasting media from said discharge openings of said first and second nozzle members so that the discharged cylindrical streams, almost immediately after discharge, directly impact one another within said gap and cause the blasting media of both streams to be deflected radially outwardly in substantially perpendicular relation to the flow direction of the discharged streams to define a surrounding annular pattern for high energy impact with the boundary wall of the chamber in surrounding relationship to the gap; and simultaneously moving the nozzle members, while maintaining them in substantially stationary lengthwise relationship to one another, lengthwise in one direction along the interior chamber parallel to the discharge direction so that the blasting media as deflected outwardly into the annular pattern progressively treats the boundary wall lengthwise of the interior chamber.

14. A process according to claim 13, wherein the substantially identical streams as discharged from said nozzle members have a velocity in the range of from about 30 feet per second to about 250 feet per second.

15. A process according to claim 14, wherein the carrier fluid as supplied to said discharge nozzles comprises air at a pressure of about 80 to 90 psi.

16. A process according to claim 13, including the additional step of simultaneously moving the nozzle members, while maintaining them in substantially stationary lengthwise relationship to one another, lengthwise in the opposite direction along the interior chamber parallel to the discharge direction so that the blasting media as deflected outwardly into the annular pattern progressively treats the boundary wall lengthwise of the interior chamber.

17. An apparatus for treating boundary walls of an interior chamber formed in a workpiece and which is accessible through first and second access openings which access opposite ends of the interior chamber, said apparatus comprising:

a fixture for positioning the workpiece thereon;

first and second nozzle assemblies positioned on opposite sides of the fixture and respectively including first and second elongate nozzle members which are disposed in generally aligned but opposed relationship, said first and second nozzle members being positioned for insertion through the respective first and second access openings associated with the workpiece when the workpiece is mounted on the fixture;

first and second movable supports which respectively mount the first and second nozzle assemblies thereon;

first and second drive devices interconnected to the respective first and second supports for effecting movement of the respective nozzle assembly from a retracted position wherein the respective nozzle member has a discharge end thereof spaced from the workpiece and an operational position wherein the respective nozzle member is inserted through the respective access opening so that the discharge opening of the nozzle member is positioned within the interior chamber;

said first and second supports and the respective first and second nozzle assemblies mounted thereon being synchronously movable, while maintaining a substantially fixed spatial relationship between the opposed discharge openings of the nozzle members, to effect movement of the discharge openings within the interior chamber; and a supply source connected to each of the first and second nozzle members for simultaneously supplying substantially identical pressurized streams of carrier fluid and abrasive particles to both nozzle members for effecting simultaneous discharge from the nozzle members of opposed high-velocity streams of abrasive media defined by said carrier fluid having said abrasive particles entrained therein, whereby the opposed discharged streams directly impact one another within the interior chamber to cause the streams to be deflected radially outwardly in an annular pattern for high energy impact against the boundary walls of the interior chamber.

18. An apparatus according to claim 17, wherein each of said nozzle members comprises an elongate tubular member having said discharge opening at one end thereof.

19. An apparatus according to claim 17, wherein said discharge opening is defined within a carbide tip member.

20. An apparatus according to claim 17, wherein the first and second nozzle assemblies includes plural opposed pairs of first and second nozzle members which are insertable through respective access openings of the workpiece for association with different portions of the interior chamber, the plurality of first nozzle members as well as a plurality of second nozzle members being disposed in generally parallel but sidewardly spaced relationship and being simultaneously movable as a unit.

21. An apparatus according to claim 17, wherein each of said first and second supports is mounted for generally linear movement in a direction which is generally parallel with an axis which extends through the interior chamber and aligns with the first and second access openings.

22. An apparatus according to claim 21, wherein the second support is linearly movably supported on the first support for movement with respect to the first support along a direction which is generally parallel with said axis.

23. An apparatus according to claim 22, wherein said first drive device is drivingly coupled between said first support and a stationary housing, and wherein said second drive device is drivingly coupled between said first and second supports, whereby activation of said first drive device causes simultaneous linear movement of said first support and said second support.

24. An apparatus according to claim 17, including a housing structure which includes walls functioning as a shroud for defining therein a treating chamber, said fixture being positioned within said treating chamber, and said nozzle assemblies being disposed on opposite sides of the shroud so that the nozzle members movably project through the shroud for disposition within opposite sides of the treating chamber.

25. An apparatus according to claim 17, wherein the first and second nozzle assemblies and the respective first and second drive devices are mounted on a transverse movement assembly which permits the first and second nozzle assemblies to be simultaneously transversely displaced relative to the workpiece to permit the nozzles to be sequentially positioned in alignment with different interior chambers of the workpiece.

26. An apparatus according to claim 17, wherein one of the first and second drive devices has a speed control arrangement associated therewith for varying the speed of movement of the synchronously-moveable first and second nozzles as they linearly traverse the length of the interior passage.

27. An apparatus according to claim 17, wherein each of said first and second nozzles comprises an elongate nozzle member having a discharge passage extending lengthwise over a significant length thereof and terminating in a discharge opening at one end of the nozzle member, said discharge passage having a length of at least about 8 inches and a maximum diameter of about ¼ inch.

28. An apparatus according to claim 17, wherein the distance between the opposed discharge openings of the nozzle members is about one inch.

29. An apparatus according to claim 17, wherein the distance between the opposed discharge openings of the nozzle members is about one half inch or less.

30. An apparatus according to claim 17, wherein the distance between the opposed discharge openings of the nozzle members is about 0.100 to about 0.300 inches.

31. An apparatus according to claim 17, wherein said first and second nozzle assemblies each having an orifice that emits a cylindrical stream of blasting fluid.

32. An apparatus according to claim 17, wherein said first and second nozzle assemblies are identical.

33. An apparatus for treating boundary walls of an interior chamber formed in a workpiece and which is accessible through first and second access openings which access opposite ends of the interior chamber, said apparatus comprising:

a fixture for positioning the workpiece thereon;

first and second nozzle assemblies positioned on opposite sides of the fixture and respectively including first and second elongate nozzle members which are disposed in generally aligned but opposed relationship, said first and second nozzle members being positioned for insertion through the respective first and second access openings associated with the workpiece when the workpiece is mounted on the fixture;

first and second movable supports which respectively mount the first and second nozzle assemblies thereon;

a drive arrangement interconnected to the respective first and second supports for effecting movement of the respective nozzle assembly from a retracted position wherein the respective nozzle member has a discharge end thereof spaced from the workpiece and an operational position wherein the respective nozzle member is inserted through the respective access opening so that the discharge opening of the nozzle member is positioned within the interior chamber;

said first and second supports and the respective first and second nozzle assemblies mounted thereon being synchronously movable, while maintaining a substantially fixed spatial relationship between the opposed discharge openings of the nozzle members, to effect movement of the discharge openings within the interior chamber; and a supply source connected to each of the first and second nozzle members for simultaneously supplying substantially identical pressurized streams of carrier fluid and abrasive particles to both nozzle members for effecting simultaneous discharge from the nozzle members of substantially equal but opposed high-velocity streams of abrasive media defined by said carrier fluid having said abrasive particles entrained therein, whereby the opposed discharged streams directly impact one another within the interior chamber to cause the streams to be deflected radially outwardly for high energy impact against the boundary walls of the interior chamber.

* * * * *

UNITED STATES PATENT AND TRADEMARK OFFICE

CERTIFICATE OF CORRECTION

PATENT NO. : 7,063,593 B2
APPLICATION NO. : 10/782221
DATED : June 20, 2006
INVENTOR(S) : Steven J. Carpenter It is certified that error appears in the above-identified patent and that said Letters Patent is hereby corrected as shown below:

Column 22, line 9; change “according to Claim 17” to --according to Claim 18--

Signed and Sealed this

Seventh Day of November, 2006

JON W. DUDAS
*Director of the United States Patent and Trademark Office*